United States Patent [19]

O'Hara

[11] Patent Number: 4,518,012

[45] Date of Patent: May 21, 1985

[54] AIR DAMPER ASSEMBLY WITH MOVABLE BLADES

[76] Inventor: Robert J. O'Hara, P.O. Box 2129, Glenview, Ill. 60025

[21] Appl. No.: 522,784

[22] Filed: Aug. 12, 1983

Related U.S. Application Data

[63] Continuation-in-part of Ser. No. 410,560, Aug. 23, 1982.

[51] Int. Cl.[3] ..... F24F 13/16

[52] U.S. Cl. ..... 137/601; 98/121.2

[58] Field of Search ..... 137/512.1, 527.8, 601; 98/110, 121 A

[56] References Cited

U.S. PATENT DOCUMENTS

| | | | |
|---|---|---|---|
| 3,445,863 | 5/1969 | Wada | 137/512.1 X |
| 3,793,932 | 2/1974 | Tarnoff | 98/110 |
| 4,113,230 | 9/1978 | McCabe | 137/601 X |

*Primary Examiner*—Martin P. Schwadron

*Assistant Examiner*—Stephen M. Hepperle

*Attorney, Agent, or Firm*—Leydig, Voit, Osann, Mayer & Holt, Ltd.

[57] ABSTRACT

An air damper assembly has a frame which is mounted on the walls of an air flow passageway, with flanges extending inwardly from at least one pair of opposed sides of the frame. A plurality of elongated damper blades have their opposite ends extending into pairs of opposed slots formed by the frame flanges, pivotally supporting the blades on the flanges for pivoting movement between open and closed positions. A pair of retaining stop means are associated with each end of each blade. These retaining stop means project outwardly from opposite sides of the blade and on opposite sides of each of the flanges for limiting pivoting movement of the blade to an open position and for retaining the blade in the respective slots in the flanges. The main body portion of each blade limits pivoting movement of the blade to a closed position by engaging opposite sides of the flanges on which the blade is pivotally supported.

29 Claims, 13 Drawing Figures

FIG. 1
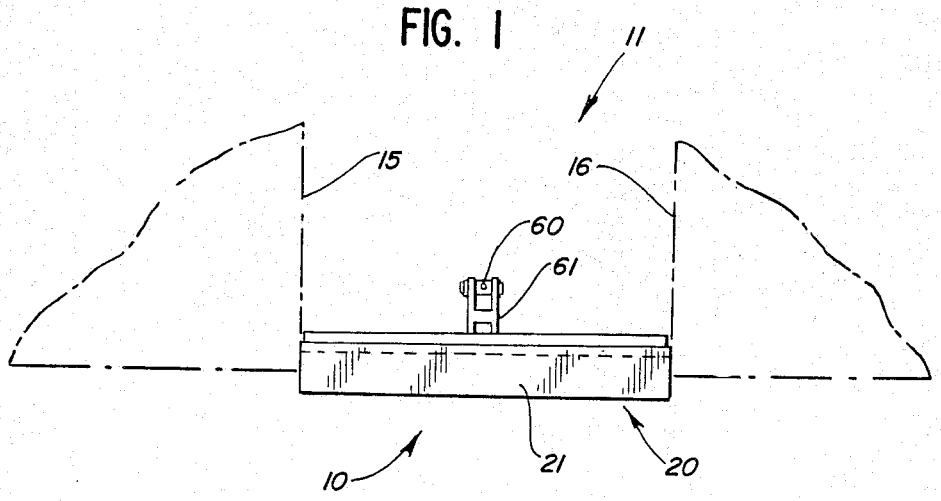
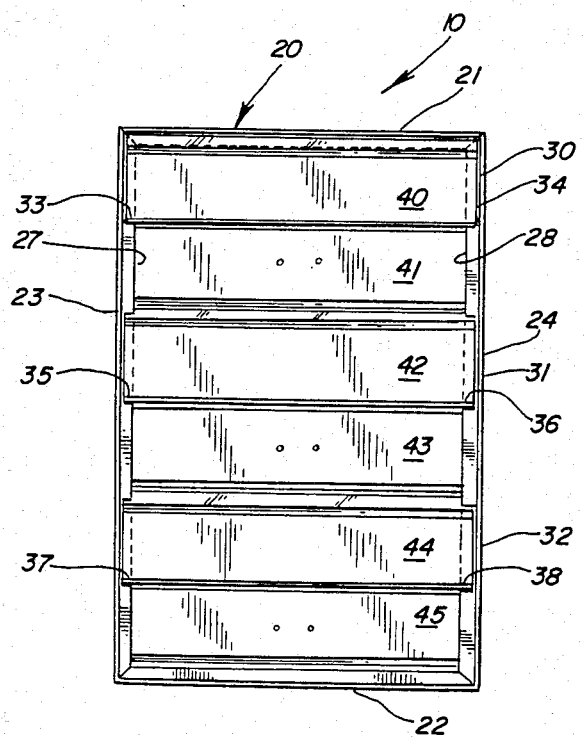
FIG. 2
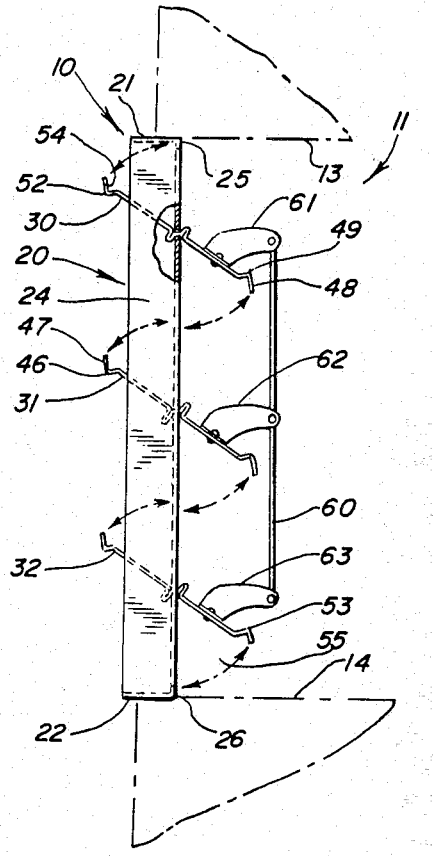
FIG. 3

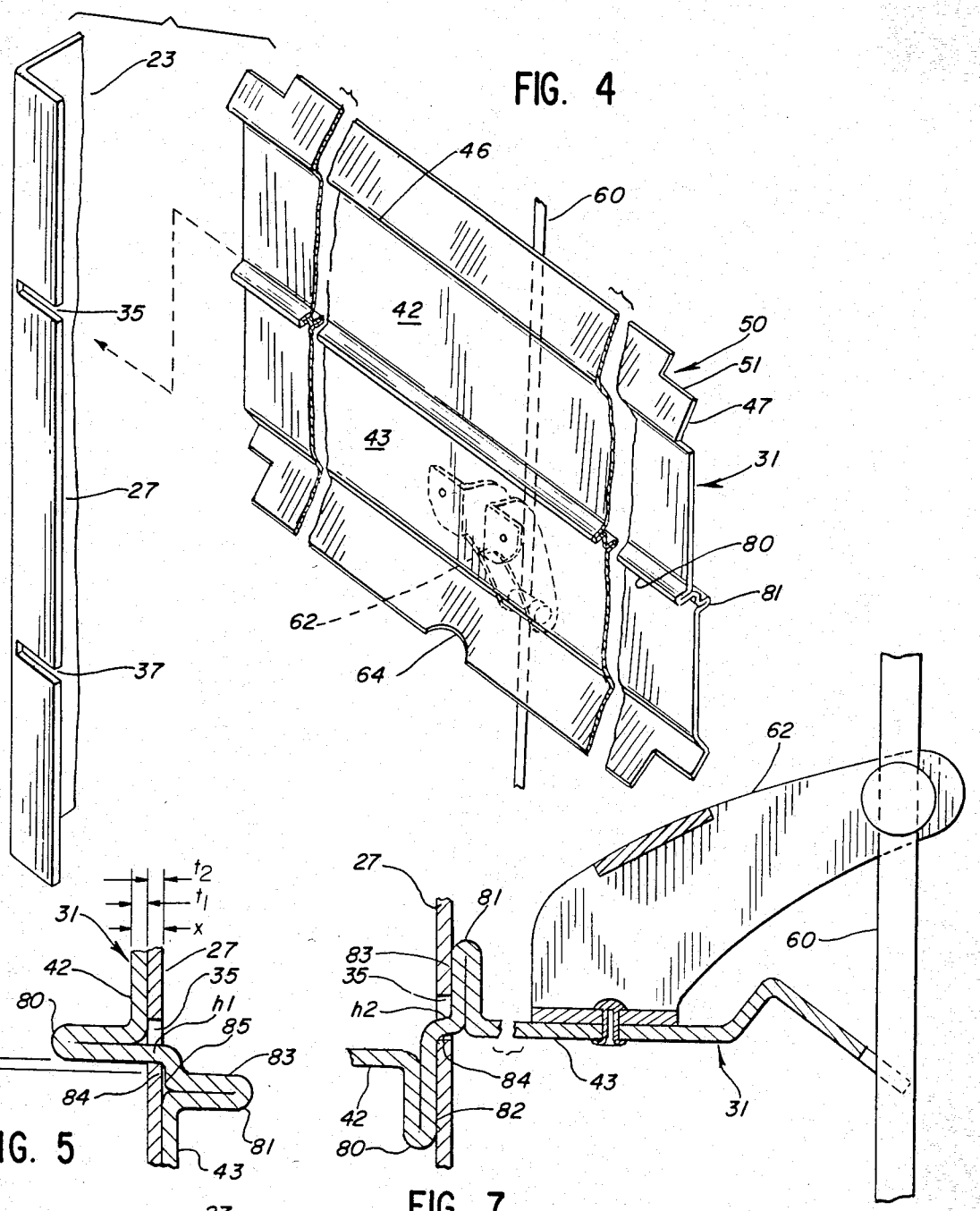
FIG. 4
FIG. 5
FIG. 7
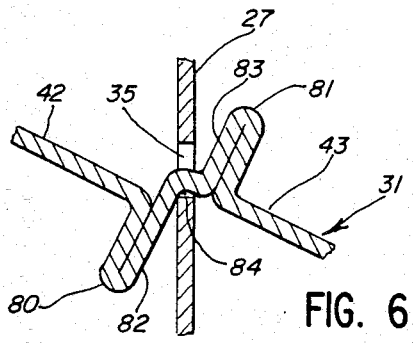
FIG. 6
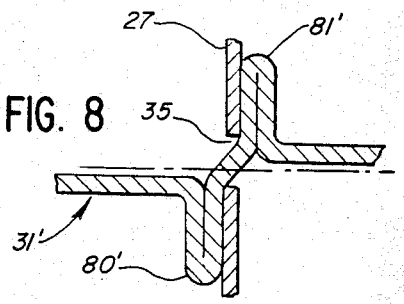
FIG. 8

FIG. 9
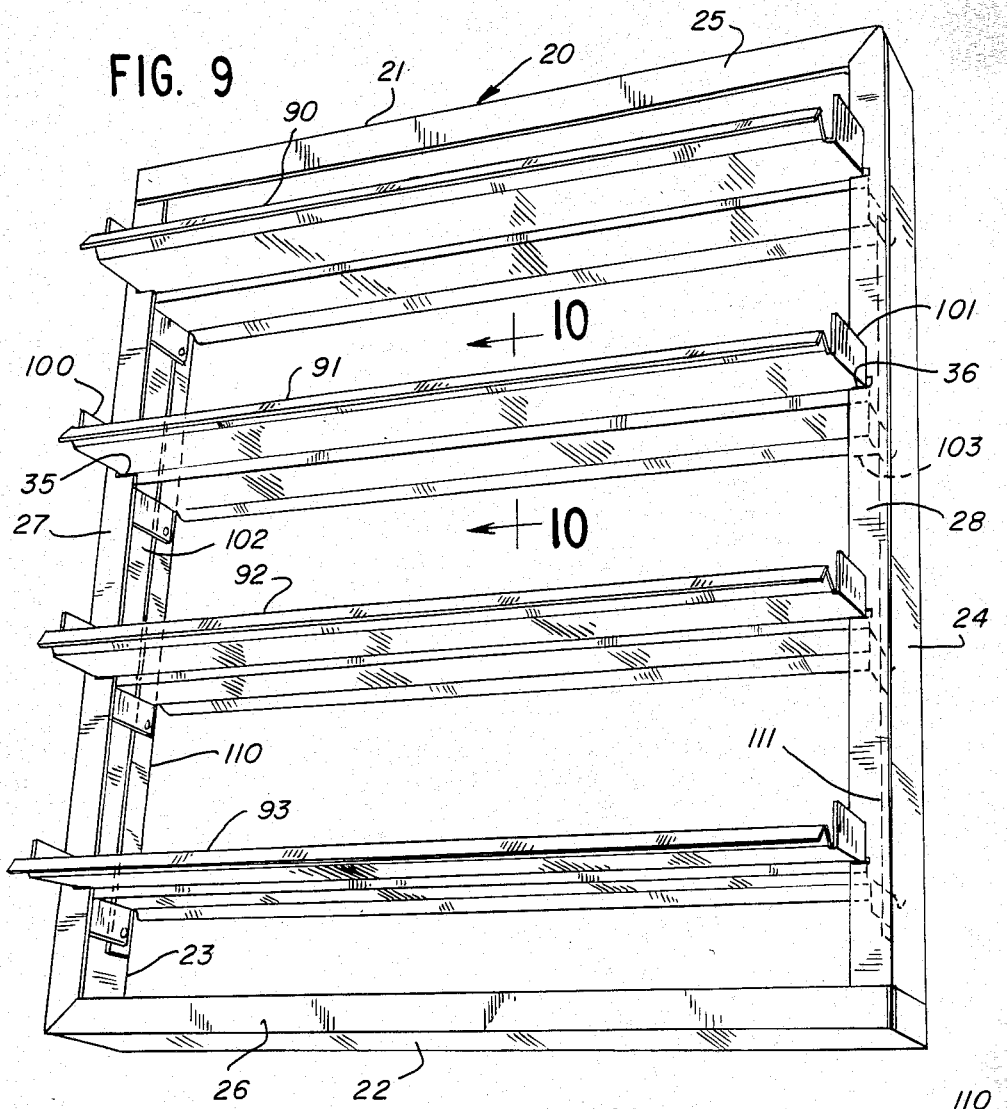
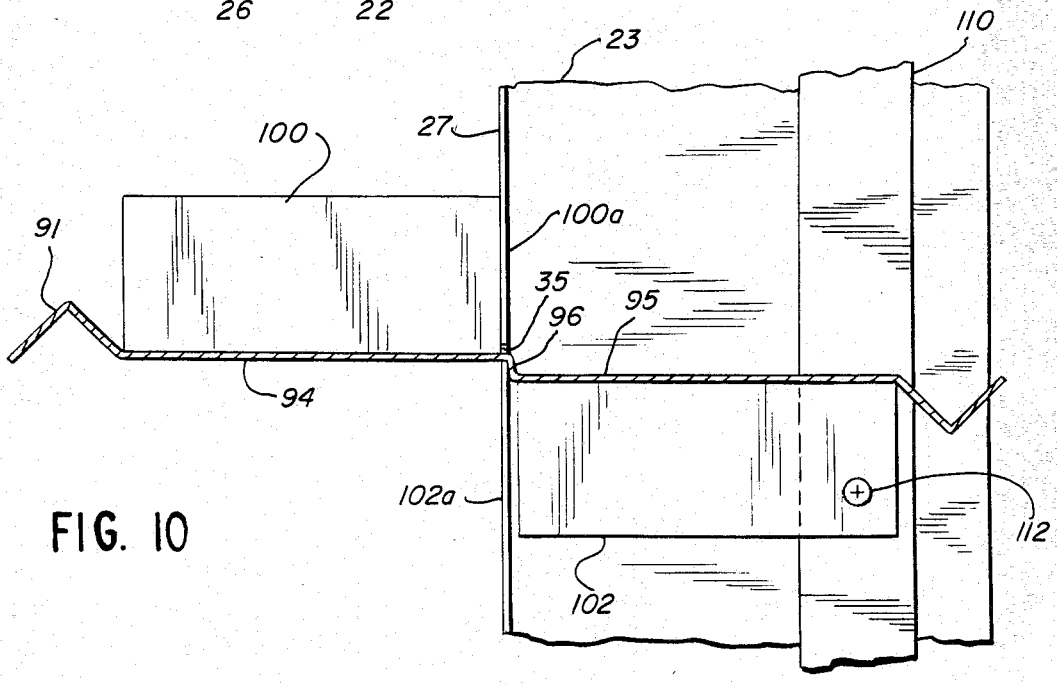
FIG. 10

AIR DAMPER ASSEMBLY WITH MOVABLE BLADES

This application is a continuation-in-part of my U.S. patent application Ser. No. 410,560, filed Aug. 23, 1982, for an "Air Damper Assembly With Movable Blades."

FIELD OF THE INVENTION

The present invention relates generally to the field of fire, smoke, backdraft and air control dampers, and, more particularly, to damper assemblies of the type that have a plurality of damper blades mounted for pivotal movement to regulate the volume of air that can be passed therethrough, or to completely block such air flow.

DESCRIPTION OF THE PRIOR ART

Air damper assemblies having stamped blades with hook-shaped integral hinges are disclosed in U.S. Pat. Nos. 4,113,232 issued Sept. 12, 1978; 4,185,657 issued Jan. 29, 1980; and 4,185,658 issued Jan. 29, 1980, to F. J. McCabe. These patents describe air damper mechanisms having a frame supporting multiple blades which themselves basically comprise two slightly spaced apart parallel sections joined or connected by a transverse connecting portion; the connecting portion provides longitudinal reinforcement for the blade while offsetting the spaced apart parallel sections by a distance at least equal to the thickness of a pair of inwardly extending flanges which support the blades on the frame. The hook-shaped hinge portions are stamped from appropriate portions of one of the parallel sections or the transverse connecting portion. The inner flanges of the frames of those dampers are substantially parallel to the plane of the blades in their closed positions and are appropriately formed at spaced intervals to receive the transverse or offsetting portion of each blade which is disposed to rotate therein as the blades are moved between the closed and open positions. To facilitate on-site fabrication of such damper mechanisms, the stamped blades and frame members may be provided unassembled in kit form.

SUMMARY OF THE INVENTION

It is a principal object of the present invention to provide an improved air damper assembly which is extremely easy and economical to manufacture and assemble in a high-speed production line, with a minimum number of parts, while at the same time providing extremely reliable operation. In this connection, one specific objective of the invention is to provide such an improved damper assembly in which all the parts can be made by relatively simple stamping, braking, extruding or roll forming operations which can be carried out at high speeds using relatively simple tooling.

It is another object of the invention to provide such an improved damper assembly which minimizes vibration between the damper blades and their supporting frame, but which also avoids the need for narrowly critical clearance tolerances between the cooperating elements which permit pivoting movement of the blades.

A further object of the invention is to provide such an improved air damper assembly which is highly effective in completely blocking the passage of air and other gases when the damper blades are pivoted to their closed positions.

Yet another object of this invention is to provide such an improved damper assembly which can be readily manufactured in different sizes for a wide variety of different applications.

A specific object of one particular embodiment of the invention is to provide such an improved damper assembly which can be manufactured entirely from flat metal stock without ever bending the stock more than 90°.

A further specific object of one embodiment of the invention is to provide such an improved damper assembly which greatly facilitates the fabrication and assembly of the linkage mechanism for opening and closing the multiple blades in unison. A related object is to provide such an assembly which greatly reduces the cost of the linkage mechanism, and which permits the linkage mechanism to be made extremely compact.

Other objects and advantages of the invention will become apparent from the following detailed description and the accompanying drawings.

In accordance with the present invention, there is provided an air damper assembly comprising the combination of a frame adapted to be mounted on the walls of an air flow passageway and having flanges extending inwardly from at least one pair of opposed sides thereof, the flanges forming pairs of opposed slots; a plurality of elongated damper blades each of which has its opposite ends extending into a pair of the opposed slots so that the blade is pivotally supported on the flanges for pivoting movement between open and closed positions; and a pair of retaining stop means associated with each end of each blade, the retaining stop means projecting outwardly from opposite sides of the blade and on opposite sides of each of the flanges for limiting pivoting movement of the blade to an open position and for retaining the blade in the respective slots in the flanges.

BRIEF DESCRIPTION OF DRAWINGS

FIG. 1 is a top plan view of a damper assembly embodying the present invention installed in a duct or passageway with the damper blades in their closed positions;

FIG. 2 is a front elevation of the damper assembly of FIG. 1;

FIG. 3 is a side elevation, partially in section, of the damper assembly of FIG. 1 with the blades in partially open positions;

FIG. 4 is an exploded perspective of one of the damper blades and a portion of the frame in the assembly of FIG. 1;

FIG. 5 is an enlarged section taken generally along line 5—5 in FIG. 1 with the blade mounted on the frame and in the closed position;

FIG. 6 is the same section shown in FIG. 5 with the blade pivoted to a partially open position;

FIG. 7 is the same section shown in FIG. 5 with the blade pivoted to its fully open position, and also showing the remainder of the lower half of the blade and the linkage mechanism mounted thereon;

FIG. 8 is a sectional view similar to FIG. 5 but of an alternative embodiment of the invention;

FIG. 9 is a front perspective of a damper assembly representing a modified embodiment of the invention, with the damper blades in their fully open positions;

FIG. 10 is an enlarged section taken generally along line 9—9 of FIG. 9;

Figure 11:
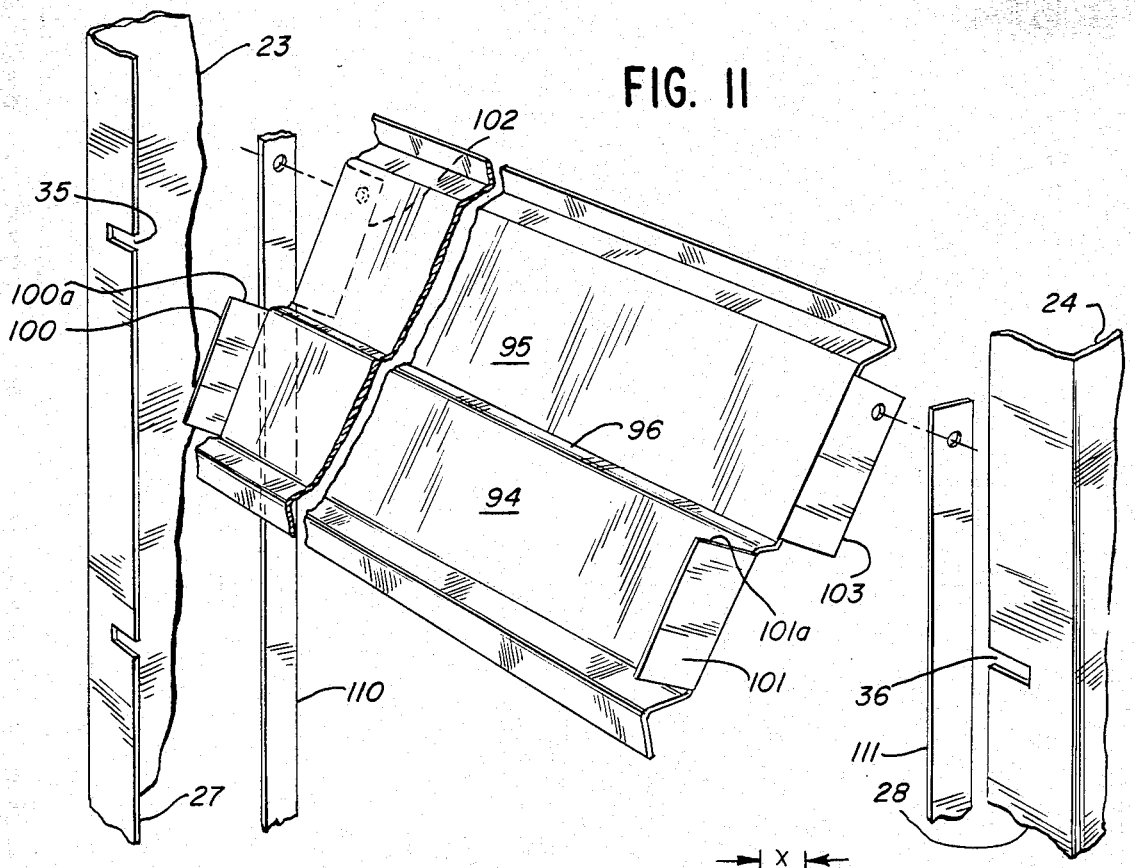
FIG. 11 is an exploded perspective of one of the damper blades and the components associated therewith in the assembly of FIG. 9.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims.

DESCRIPTION OF THE PREFERRED EMBODIMENT

Turning now to the drawings and referring first to FIGS. 1–3, there is shown an air damper assembly generally designated 10 disposed in an air duct generally designated 11 having side walls 13, 14, 15, and 16. The air damper assembly 10 has a rectangular frame 20, typically formed of sheet metal, having a top member 21, a bottom member 22, and opposed side members 23, 24 forming inwardly extending planar flanges 25, 26, 27, and 28, respectively, perpendicular to the walls of the frame and the duct. The inner edges of the flanges 27, 28 of the side members 23, 24 in conjunction with the flanges 25, 26 of the top and bottom members 21, 22 define a rectangular shelf extending into the air flow passageway bounded by the duct walls 13–16.

To permit the flow of air through the duct 11 to be regulated or shut off, a plurality of parallel damper blades 30, 31 and 32, also formed of sheet metal, are pivotally mounted within the frame 20. Each of the blades 30–32 extends horizontally across the frame, with the opposite ends of the blades fitting into respective pairs of horizontally aligned slots 33–34, 35–36 and 37–38 formed by the flanges 27 and 28. The damper blades are pivotally mounted for pivoting movement between open and closed positions.

For the purpose of blocking the opening defined by the frame 20 when the damper blades are in their closed positions, each of the blades has upper and lower generally rectangular planar sections, such as the upper and lower sections 40 and 41 of the top blade 30. The other two blades 31 and 32 have similar planar sections 42, 43 and 44, 45, respectively. The upper and lower planar sections of each blade lie in offset parallel planes, joined by an intermediate section of the blade. It is this intermediate section of the blade that extends into the slots of the side flanges to support the blade at opposite ends thereof. The longitudinal length of the blades 30–32 is greater than the distance between the opposed edges of the inwardly extending side flanges 27–28 so that the ends of the blades overlap the flanges.

When the blades 30–32 are pivoted to their closed positions (FIGS. 1, 2 and 5), the upper and lower planar sections of each blade are brought into engagement with the side flanges 27–28, with opposite sides of the planar sections of the blade resting flat against opposite sides of the flanges. Thus, the planar sections of the blades cooperate with the flanges to form a stop mechanism that defines the closed positions of the blades while also forming an effective seal against smoke, air or other gases along the major portions of the blade ends. To achieve this result, the offset x between the planes of the upper and lower planar sections of each blade is approximately equal to the thickness t1 of the blade material plus the thickness of the flanges 27–28 (see FIG. 5).

In order to form similar seals along the longitudinal edges of the blades, the blades are high enough to overlap each other when the blades are pivoted to their closed positions (see FIGS. 2 and 3). The top edge portion of the uppermost blade 30 and the bottom edge portion of the lowermost blade 32 similarly overlap the top and bottom frame flanges 25 and 26, respectively, as can be seen from the broken-line areas in FIG. 3. Thus, when the blades are in their closed positions, the air passage surrounded by the frame 20 is sealed due to the overlapping engagement of the blades 30–32 with each other and the frame 20.

As can be seen in FIGS. 3 and 4, V-shaped bends are formed in the longitudinal edge portions of each of the damper blades 30–32 so that the free longitudinal edges of adjacent blades are brought into overlapping and sliding engagement with each other as the blades are pivoted to their closed positions. For example, a V-shaped bend 46 at the top of the middle blade 31 forms an edge portion 47 which slides over a complementary edge portion 48 formed by a V-shaped bend 49 at the bottom of the top blade 30. The V bends insure that there is adequate space for the two edge portions 47 and 48 to overlap each other along a substantial area without interference from the planar sections of the blades. To permit these longitudinal edge portions of adjacent blades to engage and overlap each other, each of the four corners of the middle damper blade 31 is notched, as at 50 in FIG. 4, to fit over the corresponding side flange 27 or 28 when the blade is pivoted to its closed position. Similar notches are formed in the bottom corners of the top blade 30 and in the top corners of the bottom blade 32. The short longitudinal edge formed by each notch, such as the edge 51 formed by notch 50, engages the corresponding side flange 27 or 28 to form the desired seals at the corners of the overlapping blades, while the major longitudinal seals between the two side flanges 27 and 28 are formed by the overlapping portions of adjacent blades.

The top longitudinal edge of the top blade 30 and the bottom longitudinal edge of the bottom blade 32 are provided with shorter V-shaped ends 52 and 53, respectively, to form angled lips 54 and 55 which fit tightly against the top and bottom flanges 25 and 26 of the frame 20.

To permit the blades 30–32 to be simultaneously opened and closed, they are interconnected by a linkage formed by a vertical rod 60 pivotally connected to brackets 61, 62 and 63 riveted to the respective blades 30–32 (see FIGS. 3 and 7). Clearance between the linkage rod 60 and the blades 30–32 is provided by semi-circular notches formed in the lower edges of blades 30 and 31, such as the notch 64 in blade 31 (FIG. 4). These notches 64 permit the use of relatively short brackets 61–63, thereby minimizing the depth of the damper mechanism. The notches 64 are small enough to be overlapped by the edge portions of the adjacent blades when the blades are in their closed positions.

In accordance with one important aspect of the present invention, the opposite ends of each blade have a pair of retaining stop means projecting outwardly from opposite sides of the blade, and on opposite sides of the supporting frame flanges, for limiting the pivoting movement of the blade in its open position while also retaining the blade in the frame slots in which it pivots. These retaining stop means enable the intermediate sections of the blades to function as integral hinges, pivoting about the bottom surfaces of the frame slots in which the blades are mounted. In the illustrative embodiment of the invention, this hinge action is illustrated by the sequential cross-sectional views of FIGS. 5, 6 and 7, which show fragments of blade 31 and flange 27 with the blade in three different positions.

The retaining stop means in the illustrative embodiment are formed by a pair of longitudinal folds 80 and 81 formed at the inner edges of the planar sections 42 and 43. These folds 80 and 81 project outwardly from opposite sides of the blade 31, forming perpendicular stop surfaces 82 and 83 for engaging opposite sides of the flanges 27 and 28 and thereby defining the open position of the blade. More specifically, the two stop surfaces lie in planes that are offset by a distance y equal to the thickness of the flanges 27 and 28.

In FIG. 5 the blade 31 is in its closed position with segment h1 of the intermediate section of the blade resting on the bottom wall of the slot, and with the upper and lower planar sections 42 and 43 of the blade in overlapping engagement with opposite sides of the supporting flange 27. The segment h1 of the intermediate blade section is the segment which offsets the upper and lower planar sections 42 and 43 of the blade by the distance x so that they are positioned to engage opposite sides of the flange 27 when the blade is in its closed position.

In FIG. 6 the blade 31 has been pivoted to an intermediate position between its open and closed positions, and it can be seen that the intermediate section of the blade has actually been shifted slightly to the left. That is, the integral hinge does not have a precisely defined pivoting axis; rather, the intermediate section of the blade slides over the bottom wall of the slot 35 as the blade is pivoted.

In FIG. 7, the blade 31 has been pivoted to its fully open position, with the upper and lower planar sections 42 and 43 extending perpendicular to the plane of the supporting flange 27 and with the stops 80 and 81 in overlapping engagement with opposite sides of the supporting flange 27. In this fully open position, segment h2 of the intermediate blade section rests on the bottom wall of the slot. It is this segment h2 which offsets the two stop surfaces 82 and 83 by the distance y so that they are positioned to engage opposite sides of the supporting flange 27 when the blade is in the desired open position. It will be noted that the intermediate section of the blade 31 has shifted still farther to the left during its pivotal movement to this fully open position.

The intermediate blade section **12*c* has a pronounced inflection 84, which may be considered as the central axis of the hinge. This pronounced inflection assures that the damper blade pivots about the central region of the intermediate section of the blade as it slides over the bottom wall of the slot 35. It has been found that this sliding action does not in any way hinder the operation of the damper mechanism, and in fact this hinging action appears to be especially immune from jamming or becoming frozen, due to corrosion for example. Moreover, the play in the hinge assembly does not lead to noise or vibration, as sometimes occurs in air ducts or damper mechanisms, because the damper assembly is ordinarily in the fully open position (FIG. 7) in which the stops 80 and 81 firmly engage opposite sides of the supporting flanges 27 and 28**.

As shown most clearly in FIG. 5, there is a slight clearance 85 between segment h2 of the intermediate section of blade 31 and the adjacent surface of the side flange 27. This slight clearance 85 is provided to ensure that the lower planar blade section 43 seats firmly against the cooperating surface of the side flange 27 when the damper blade 31 is in its closed position. In addition, the clearance 85 facilitates pivoting movement of the blade between its open and closed positions.

It should be noted that the projecting stops 80 and 81 also serve to confine the intermediate section of the blade 31 within the slots 35, 36 of the flanges 27, 28 during pivotal movement of the blade. Thus, the stops 80 and 81 project outwardly from opposite sides of the blade 31 far enough that the stops always extend beyond the edges of the slots 35, 36 during pivotal movement of the blade. Alternatively, the force of gravity may be relied upon to keep the intermediate section of the blade in contact with the bottom walls of the slots 35, 36 so that the lower stop 81 need not project as far from the blade as the upper stop 80. This alternative should be used only in those applications where there is no danger of jarring the blades out of their slots.

The stops 80 and 81 need not be formed by integral folds extending along the full lengths of the blade. Instead of the integral folds, the stops can be formed by separate elements fastened to the blades, such as angle brackets riveted, welded, or otherwise secured to the the blades. Such non-integral stop means can be particularly useful in applications where the desired thickness of the metal blades would make it difficult to bend the sheet metal to form integral folds. Integral stops could also be formed by extruding the blades rather than using a roll former or press. Another possible modification, with either integral or non-integral stops, is to limit the stops to only the end portions of the blades which overlap the supporting flanges of the frame.

FIG. 8 shows another possible modification which is useful when the damper blades must be formed from relatively heavy sheet metal, which makes it difficult to form rightangle corners in the intermediate sections of the blades. The modified embodiment of FIG. 8 requires only 45° corners in the intermediate section of the blade.

A particularly preferred modified embodiment of the invention is illustrated in FIGS. 9–13. This embodiment reduces the overall cost of the damper assembly, particularly when it is desired to form the damper assembly from relatively heavy gauge sheet metal. For example, the embodiment of FIGS. 9–13 can be made without ever bending the sheet metal stock more than 90°. This structure also makes it possible to significantly reduce the cost of the linkage mechanism, and at the same time permits the linkage mechanism to be made much more compact.

The frame 20 used in the embodiment of FIGS. 9–13 is identical to the frame used in the embodiment of FIGS. 1–7 described above, and, therefore, the various elements of the frame have been identified by the same reference numerals in FIGS. 9–13. However, the damper blades 90, 91, 92 and 93 in the embodiment of FIGS. 9–13 are significantly different from the blades used in the first embodiment. More specifically, the longitudinal folds 80 and 81 which form the retaining stops in the previously described blades 30–32 have been eliminated from the blades 90–93 and replaced with end flanges 100–103 which form the requisite retaining stops projecting outwardly from opposite sides of each blade. Each of the four flanges 100–103 on each of the blades 90–93 is preferably formed by an integral longitudinal extension of one of the planar sections 94 or 95 of the blade, the longitudinal extension being bent at a right angle to the main body portion of the blade. These bends are made along transverse fold lines that are perpendicular to the longitudinal axes of the blades, forming flanges 100–103 lying in planes that are generally perpendicular to the planes of the slotted frame flanges 27, 28 and, preferably, also perpendicular to the main body portion of the respective blades. The two flanges 100 and 101 on the front blade section 94 are bent upwardly to form stop surfaces 100*a*, 101*a* for engaging the front sides of the corresponding frame flanges 27 and 28 (viewing the blade in its open position as shown in FIG. 10). The two flanges 102 and 103 on the rear blade section 95 are bent downwardly from the plane of the blade to form stop surfaces 102*a*, 103*a* for engaging the rear sides of the flanges 27, 28 (again, viewing the blade in its open position).

The hinge portion of the blades 90–93 is formed in the same manner as in the blades 30–32 described previously. That is, the front and rear planar sections 94 and 95 of each blade 90–93 are offset from each other in parallel planes, joined by an intermediate section 96. This intermediate blade section 96 extends into one of the pairs of frame slots, such as slots 35–36 to support the blade at opposite ends thereof while permitting pivotal movement of the blade within the frame slots. The pivoting action is the same as described previously, with the intermediate blade section 96 sliding over the bottom walls of the corresponding pair of frame slots as the blade is pivoted.

Figure 13:
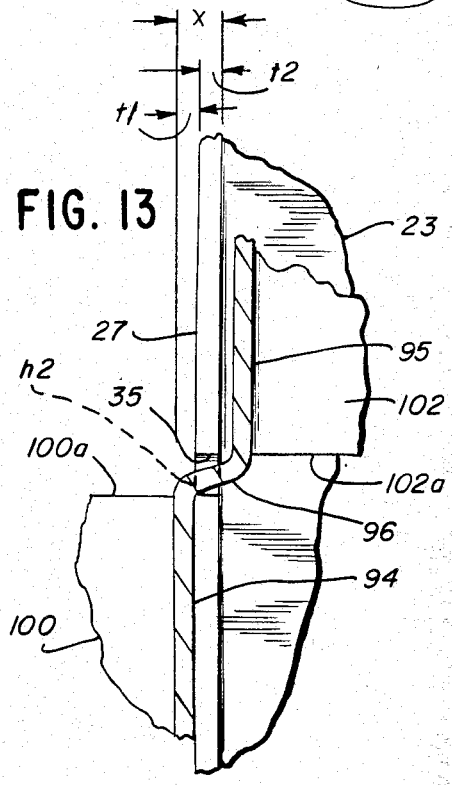
FIG. 13 is the same view shown in FIG. 12 with the damper blade in its fully closed position.

When the blades 90–93 are pivoted to their closed positions, as illustrated in FIG. 13, the front and rear planar sections 94, 95 of each blade are brought into engagement with the side flanges 27, 28. In this fully closed position, opposite sides of the planar sections 94, 95 rest flat against opposite sides of the flanges 27, 28, with the intermediate blade section 96 oriented horizontally with section h2 thereof resting on the bottom walls of the slots 35, 36. As in the case of the earlier embodiment, the offset x between the planes of the front and rear blade sections 94, 95 is approximately equal to the thickness t1 of the blade material plus the thickness t2 of the flanges 27, 28 (see FIG. 13).

Figure 12:
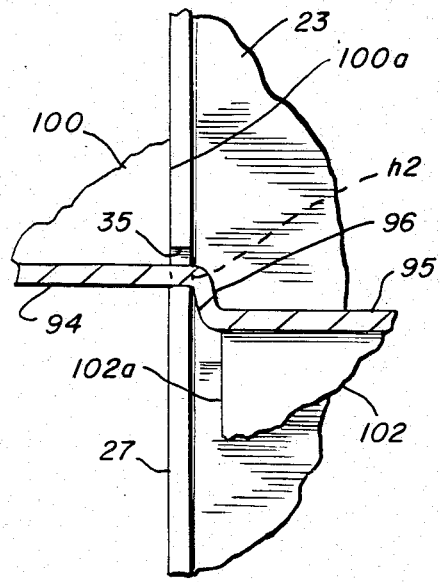
FIG. 12 is an enlargement of the central portion of the damper blade in FIG. 10.

When the blades 90–93 are pivoted to their fully open positions, as illustrated in FIGS. 9, 10 and 12, the stop surfaces 100*a*, 101*a* of the two front flanges 100, 101 engage the front surfaces of the adjacent flanges 27, 28 to limit and define the fully open positions of the blades 90–93. In this fully open position, section h1 of the front planar blade section 94 rests on the bottom walls of the slots 35, 36, with the intermediate blade section 96 extending downwardly along the inside surface of the flanges 27, 28. In the particular embodiment illustrated, the stop surfaces 102*a*, 103*a* formed by the front edges of the rear flanges 102, 103 are spaced away from the inside surfaces of the flanges 27, 28 by the thickness of the blade, but it will be appreciated that the width of the flanges 102 and 103 could be increased slightly so that the front edges 102*a* and 103*a* of these flanges would also engage the inside surfaces of the respective flangues 27 and 28 in the fully open position of the blades.

As can be clearly appreciated from FIGS. 12 and 13, the end flanges 100–103 prevent the blades 90–93 from slipping out of their respective slots (e.g., slots 35–36) as the blades are pivoted about the bottom surfaces of the slots. Thus, the stop surfaces 100*a*–103*a* project outwardly from opposite sides of the respective blades 90–93 beyond the edges of the corresponding slots to prevent the blades from escaping from their slots as they are pivoted between their open and closed positions.

It will be appreciated that the blades 90–93 used in the embodiments of FIGS. 9–13 can be fabricated without ever bending the metal sheet stock more than 90°. Thus, the intermediate section 96 is formed by two simple 90° bends, as is each of the end flanges 100–103. Consequently, these blades can be efficiently and rapidly fabricated by relatively simple stamping or forming operations without unduly stressing the metal. These blades do not require the 180° bends required to form the folds 80–81 in the embodiment of FIGS. 1–7.

To achieve one of the specific objectives of this particular embodiment of the invention, the mechanical linkage which is used to pivot all the blades 90–92 in unison is formed by pivotally connecting a pair of flat metal bars 110 and 111 to the rear end flanges 102 and 103. More specifically, the bar 110 is connected to the flanges 102 on one end of the three blades 90–93, and the bar 111 is connected to the flanges 103 at the other end of the blades. The pivotal connections between the bars 110, 111 and the flanges 102, 103, such as the pivotal connection 112 shown in FIG. 10, can be formed by any of a number of different conventional fastening devices, such as rivets. It will be appreciated that this linkage mechanism is vastly simpler and more economical to fabricate than the linkage mechanism utilized in the embodiment of FIGS. 1–7. It requires no special forming operations, other than the drilling of holes for the pivotal connections 112, and can be fabricated entirely from flat stock. Furthermore, the depth of the damper assembly, being contained entirely within the interior of the frame 20.

The illustrative damper assemblies described above are designed to be manufactured and sold as complete units, and a plurality of different sizes would be manufactured for placement in ducts or openings of various standard sizes. Alternatively, a damper kit may be manufactured containing a plurality of blades, linkage hardware, and frame members including the necessary slotted flanges. Such damper kits are desirable for on-site fabrication of damper assemblies to fit ducts of nonstandard sizes. The extremely simple, integral hinge construction of the present invention, which requires only a minimum number of parts, facilitates the on-site assembly of dampers from such kits. The damper blades are easily aligned and inserted into the slots, and the dimensions of the slots are not narrowly critical. Indeed, the slotted frame members can even be manufactured in the field by cutting the slots with available power tools. If desired, the blades used in the embodiment of FIGS. 1–8 can be manufactured in long lengths and then cut to size in the field.

It should be noted that the present invention is not limited to fire damper applications, but is also useful in air damper mechanisms which are user-adjustable to regulate the flow of air to a desired level by controlling the angles of the blades. The invention is also useful in back draft dampers and explosion shutters, the latter of which can be subjected to stresses that are even more severe than those encountered in fire dampers.

As will be apparent to persons skilled in this art, the precise shape or configuration of the integral hinge arrangement may be altered from the preferred form shown in the drawings. In particular, it should be noted that the hinge arrangement permits relative angular motion of the hinge portion of the blade and the slotted flanges of the supporting frame. Thus, it is possible to form the stop members in the side flanges of the frame and slot the intermediate section of the blade to fit over the side flanges between the stop members formed thereby. To see that this interchange of hinge members would in fact produce an operating device, one need only turn FIG. 5 upside down and consider the planar section 27 to represent the blade rather than the frame.

Another possible modification of the illustrative embodiment of the invention is to change the angle of orientation of every other blade in a given assembly so that each pair of adjacent blades lie in intersecting planes. Adjacent blade edges then move toward each other on the same side of the frame when the blades are pivoted toward their closed positions, and the dimensions and geometry of the blades must be such that the edge of one blade leads the opposed edge of the adjacent blade so that the two blade edges clean each other during closing and opening movement thereof.

As can be seen from the foregoing detailed description, the present invention provides an improved air damper assembly which is extremely easy and economical to manufacture and assemble in a high-speed production line, with a minimum number of parts, while at the same time providing extremely reliable operation. All the parts required for this damper assembly can be made by relatively simple stamping or roll forming operations which can be carried out at high speeds using relatively simple tooling. Furthermore, this improved damper assembly minimizes vibration of the damper blades and their supporting frame, and also avoids the need for narrowly critical clearance tolerances between the cooperating elements which permit pivoting movement of the blades. The mechanism can be readily manufactured in different sizes for a wide variety of different applications, and it is highly effective in completely blocking the passage of air when the damper blades are pivoted to their closed positions.

I claim as my invention:

1. An air damper assembly comprising the combination of a frame adapted to be mounted on the walls of an air flow passageway and having flanges extending inwardly from at least one pair of opposed sides thereof, said flanges forming pairs of opposed slots, a plurality of elongated damper blades each of which has its opposite ends extending into a pair of said opposed slots so that the blade is pivotally supported on said flanges for pivoting movement between open and closed positions, and a pair of retaining stop means associated with each end of each blade, said retaining stop means projecting outwardly from opposite sides of the blade and on opposite sides of each of said flanges for limiting pivoting movement of the blade to an open position and for retaining the blade in the respective slots in said flanges.

2. An air damper assembly as set forth in claim 1 wherein the main body portion of each blade limits pivoting movement of the blade to a closed position by engaging said flanges when the blade is pivoted to said closed position.

3. An air damper assembly as set forth in claim 1 wherein said retaining stop means limit the pivoting movement of the blade by engaging said flanges when the blade is pivoted to said open position.

4. An air damper assembly as set forth in claim 1 wherein said retaining stop means are formed as integral parts of said blades.

5. An air damper assembly as set forth in claim 1 wherein said retaining stop means project outwardly from the respective blades beyond the edges of said slots when the blades are in their open positions and during pivoting movement of the blades between the open and closed positions.

6. An air damper assembly as set forth in claim 1 wherein said pair of retaining stop means are spaced apart by an intermediate section of each blade, said intermediate section including a first segment which spaces said retaining stop means from each other by a distance which is about equal to the thickness of said flanges, and a second segment which introduces an offset into the main body portion of the blade, said offset being about equal to the sum of the thickness of said flanges and the thickness of the blade.

7. An air damper assembly as set forth in claim 1 wherein said retaining stop means are formed by integral flanges on the ends of each blade and lying in planes that are generally perpendicular to the plane of said slotted flanges of said frame so that at least one edge of said integral flanges on each end of each blade engages said slotted flanges when the blade is pivoted to its open position.

8. An air damper assembly as set forth in claim 7 wherein said integral flanges extend outwardly from the main body portion of each blade in opposite directions on opposite sides of the pivoting axis of the blade.

9. An air damper assembly as set forth in claim 7 wherein said integral flanges lie in planes which are generally perpendicular to the planes of the main body portions of the respective blades.

10. An air damper assembly as set forth in claim 7 wherein said integral flanges on the ends of said blades extend beyond the corresponding edges of said slots in the adjacent slotted flanges of said frame.

11. An air damper assembly as set forth in claim 7 which includes linkage means pivotally connected to said integral flanges on one side of said blades for pivoting the plurality of blades in unison.

12. An air damper assembly as set forth in claim 11 wherein said linkage means comprises a pair of flat metal bars extending along opposite ends of said blades and overlapping one of said integral flanges on each end of each blade, and which includes means pivotally connected each of said flat metal bars to each integral flange overlapped thereby.

13. An air damper assembly as set forth in claim 11 wherein said flat metal bars are disposed within the interior of said frame.

14. An air damper assembly as set forth in claim 7 wherein said integral flanges are formed by longitudinal extensions of the ends of said blades, said extensions being bent perpendicular to said blades.

15. An air damper assembly comprising the combination of a rectangular frame having top, bottom and opposed side members defining a plane perpendicular to an air flow path, the side members having inwardly extending planar flanges defining a rectangular shelf around an air flow opening;

a plurality of individual generally rectangular blades, each of the blades being pivotally supported at opposite ends in a pair of generally horizontal slots in an opposed pair of said flanges, each of the blades having upper and lower generally rectangular planar sections lying in offset parallel planes and an intermediate section joining the upper and lower sections and passing through the horizontal slots in the flanges at the ends of the blade, the offset between the planes of the upper and lower sections of the blades are substantially parallel to said flanges, each of the longitudinal edge portions of the blades being in overlapping sealing engagement with the longitudinal edge portions of an adjacent blade or the edge portion of the top or bottom frame member in said closed position, said horizontal slots being sufficiently wide to permit at least approximately 90° of pivoting movement by the blades about said intermediate sections thereof, and the intermediate section of each blade forming an upper retaining stop adjacent to the upper blade section and a lower retaining stop adjacent to the lower blade section, the stops projecting in opposite directions from and generally perpendicular to the planar sections of the blade, the stops having generally planar stop surfaces lying in offset longitudinal planes generally perpendicular to the plane of the blade, the offset between the longitudinal planes being approximately equal to the thickness of the supporting flange and projecting therefrom at least as far as the width of the corresponding horizontal slots in the supporting flanges so that the intermediate section between the stops is retained in the corresponding horizontal slots over the entire range of pivotal movement of the blade, said planar stop surfaces contacting cooperating surfaces of the supporting flanges when the blade is rotated to its fully open, generally horizontal position, and linkage means interconnecting the blades for simultaneous opening and closing of the blades.

16. An air damper assembly as set forth in claim 15 wherein each blade is formed of a single metal sheet, the stops being formed by longitudinal folds in the sheet extending along the length of each blade.

17. An air damper assembly as set forth in claim 15 wherein the intermediate section of each blade extends between said stop surfaces at an angle of approximately 45 degrees with respect to the planar sections of the blade.

18. An air damper assembly in claim 15 wherein a portion of the intermediate section between said stop surfaces of each blade is generally coplanar with said lower blade section, and another portion of said intermediate section is generally perpendicular to said lower blade section.

19. An air damper assembly as set forth in claim 18 wherein said coplanar portion of the intermediate section of the blade between said stops is slightly offset from the plane of the lower blade section, thereby facilitating sealing engagement of the side edge portions of the blade with the surfaces of the supporting flanges.

20. An air damper assembly comprising the combination of a frame adapted to be mounted on the walls of an air flow passageway and having flanges extending inwardly from at least one pair of opposed sides thereof, said flanges forming pairs of opposed slots, a plurality of elongated damper blades each of which has its opposite ends extending into a pair of said opposed slots so that the blade is pivotally supported on said flanges for pivoting movement between open and closed positions, a pair of retaining stop means formed by integral flanges on the ends of each blade and lying in planes that are generally perpendicular to the plane of said slotted flanges of said frame so that at least one edge of said integral flanges on each end of each blade engages said slotted flanges when the blade is pivoted to its open position.

21. An air damper assembly as set forth in claim 20 wherein said retaining stop means as formed by integral flanges on the ends of each blade and lying in planes that are generally perpendicular to the plane of said slotted flanges of said frame so that at least one edge of said integral flanges on each end of each blade engages said slotted flanges when the blade is pivoted to its open position.

22. An air damper assembly as set forth in claim 21 wherein said integral flanges extend outwardly from the main body portion of each blade in opposite directions on opposite sides of the pivoting axis of the blade.

23. An air damper assembly as set forth in claim 21 wherein said integral flanges lie in planes which are generally perpendicular to the planes of the main body portions of the respective blades.

24. An air damper assembly as set forth in claim 21 wherein said integral flanges on the ends of said blades extend beyond the corresponding edges of said slots in the adjacent slotted flanges of said frame.

25. An air damper assembly as set forth in claim 21 which includes linkage means pivotally connected to said integral flanges on one side of said blades for pivoting the plurality of blades in unison.

26. An air damper assembly as set forth in claim 25 wherein said linkage means comprises a pair of flat metal bars extending along opposite ends of said blades and overlapping one of said integral flanges on each end of each blade, and which includes means pivotally connected each of said flat metal bars to each integral flange overlapped thereby.

27. An air damper assembly as set forth in claim 25 wherein said flange metal bars are disposed within the interior of said frame.

28. An air damper assembly as set forth in claim 21 wherein said integral flanges are formed by longitudinal extensions of the ends of said blades, said extensions being bent perpendicular to said blades.

29. An air damper assembly comprising the combination of a rectangular frame having top, bottom and opposed side members defining a plane perpendicular to an air flow path, the side members having inwardly extending planar flanges defining a rectangular shelf around an air flow opening;

a plurality of individual generally rectangular blades, each of the blades being pivotally supported at opposite ends in a pair of generally horizontal slots in an opposed pair of said flanges, each of the blades having upper and lower generally rectangular planar sections lying in offset parallel planes and an intermediate section joining the upper and lower sections and passing through the horizontal slots in the flanges at the ends of the blade, the offset between the planes of the upper and lower blade sections being approximately equal to the thickness of the blade plus the thickness of the flanges, so that opposite sides of the blades engage opposite sides of the flanges to effect a seal when the blades are pivoted to a closed position where the upper and lower sections of the blades are substantially parallel to said flanges, each of the longitudinal edge portions of the blades being in overlapping sealing engagement with the longitudinal edge portions of an adjacent blade or the edge portion of the top or bottom frame member in said closed position, said horizontal slots being sufficiently wide to permit at least approximately 90° of pivoting movement by the blades about said intermediate section thereof, and the ends of each blade forming an upper retaining stop adjacent to the upper blade section and a lower retaining stop adjacent to the lower blade section, the stops projecting in opposite directions from and generally perpendicular to the planar sections of the blade, the offset between the longitudinal planes being approximately equal to the thickness of the supporting flange and projecting therefrom at least as far as the width of the corresponding horizontal slots over the entire range of pivotal movement of the blade, said stop edges contacting cooperating surfaces of the supporting flanges when the blade is rotated to its fully open, generally horizontal position, and linkage means interconnecting the blades for simultaneous opening and closing, said means includes a bar pivotally connected to said retaining stops so that said blades move in unison to thte open and closed positions.

* * * * *